US006322338B1

(12) United States Patent
Nishio

(10) Patent No.: US 6,322,338 B1
(45) Date of Patent: Nov. 27, 2001

(54) PULSATION DAMPING DEVICE FOR A PUMP

(75) Inventor: Kiyoshi Nishio, Sanda (JP)

(73) Assignee: Nippon Pillar Packing Co., Ltd., Osaka (JP)

( * ) Notice: Subject to any disclaimer, the term of this patent is extended or adjusted under 35 U.S.C. 154(b) by 0 days.

(21) Appl. No.: 09/581,173

(22) PCT Filed: Oct. 26, 1998

(86) PCT No.: PCT/JP98/04817

§ 371 Date: Jun. 14, 2000

§ 102(e) Date: Jun. 14, 2000

(87) PCT Pub. No.: WO00/25023

PCT Pub. Date: May 4, 2000

(51) Int. Cl.[7] ..... F04B 11/00
(52) U.S. Cl. ..... 417/540; 138/30; 417/394
(58) Field of Search ..... 417/394, 395, 417/540; 138/30

(56) References Cited

U.S. PATENT DOCUMENTS 3,741,692 * 6/1973 Rupp ..... 417/540

FOREIGN PATENT DOCUMENTS 4-27185 3/1992 (JP) .
6-17752 1/1994 (JP) .
8-159016 6/1996 (JP) .
10-196521 7/1998 (JP) .

* cited by examiner

*Primary Examiner*—Michael Koczo
(74) *Attorney, Agent, or Firm*—Jones, Tullar & Cooper, P.C.

(57) ABSTRACT

According to the present invention, a device body casing 17 has a liquid chamber 20*a* for temporarily storing a liquid to be transported by a pump, a gas chamber 20*b*, and an extendably and contractibly deformable pulsation suppression diaphragm 18, which separate them. The device body casing 17 having an aperture 27 so as to communicate with gas chamber 20*b*, is detachably engaged with a valve case 23. The valve case 23 is provided with an automatic gas supply valve mechanism 33 and an automatic gas exhaust valve mechanism 34, which restrict the amount of the extendable and contractible deformation of the pulsation suppression diaphragm 18 within the predetermined range, so that a liquid pressure inside the liquid chamber 20*a* and an atmospheric pressure inside the gas chamber 20*b* may balance each other when the discharge pressure of the pump is fluctuated. The automatic gas exhaust valve mechanism 34 is provided with a gas exhaust port 32, a gas exhaust valve element 43, and a slider 48. The gas exhaust port 32 exhausts the gas from the gas chamber 20*b* to the outside, when the gas sealing pressure inside the gas chamber 20*b* is decreased. The gas exhaust valve element 43 usually makes the gas exhaust port 32 close. The slider 48 is operated so that the gas exhaust valve element 43 may usually make the gas exhaust port 32 open, when the pulsation suppression diaphragm 18 is moved in a direction of reducing the liquid chamber 20*a* so as to exceed the predetermined stroke. The gas exhaust valve element 43 is disposed on a tip of the gas exhaust valve rod 45. A rear end of the gas exhaust valve rod 45 is slidably inserted in the slider 48. The gas exhaust valve rod 45 is loosely inserted in a through hole 46 of the spring receiving member 47 fixed to the inside of the gas exhaust chamber 42 of the valve case 23. On the gas exhaust rod 45, a spring 49 for a closing state is disposed between the gas exhaust valve element 43 and the spring receiving member 47, and a spring 50 for an opening state is disposed between the spring receiving member 47 and the slider 48.

4 Claims, 5 Drawing Sheets

PULSATION DAMPING DEVICE FOR A PUMP

TECHNICAL FIELD

The present invention relates to a pulsation damping device for a pump, which damps a pulsation caused by fluctuations of a flow rate and a pressure of a liquid to be transported such as processing chemical liquids used in a semiconductor production, via a piping system for supplying the transported liquid to each element by a reciprocal pump.

BACKGROUND ART

A pulsation damping device for a pump of this type, has been disclosed in, for example, Japanese Patent Publication Laying-open Nos. 6-17752 and 8-159016.

The pulsation damping device for a pump shown in Japanese Patent Publication Laying-open No. 6-17752 is illustrated in FIG. 4. The proposed pulsation damping device has a hermetical device body casing 60, a liquid chamber 61*a* disposed inside the device body casing 60, for functioning as a storage of the liquid, which sucks and stores temporarily the transported liquid by the reciprocal pump, and discharges it, and a gas chamber 61*b* disposed inside the device body casing 60, which is separated from the liquid chamber 61*a* via an extendable and contractible diaphragm 62 for suppressing pulsation, so as to seal a gas, whereby the pulsation suppression diaphragm is extendably and contractibly deformed by pulsation of the discharge pressure of the pump. The proposed device has the above configuration, thereby making it possible to damp the pulsation by change of the capacity of the liquid chamber 61*a*.

When the discharge pressure of the reciprocal pump is fluctuated, it is necessary to keep the deformation amount of the pulsation suppression diaphragm 62 caused by extension and contraction, within a predetermined range, so that the liquid pressure inside the liquid chamber 61*a* and an atmospheric pressure inside the gas chamber 61*b* may balance each other. Therefore, the device as shown in FIG. 4 adopts the following configuration. The device body casing 60 is provided with an automatic gas supply valve mechanism 63 and an automatic gas exhaust valve mechanism 64. When the pulsation suppression diaphragm 62 is extendably deformed by the fluctuation of the liquid pressure inside the liquid chamber 61*a,* in the direction wherein the capacity of the liquid chamber is increased so as to be above a standard value S, thereby exceeding a predetermined range A, the diaphragm 62 for suppressing pulsation opens the gas supply port 66 via the valve press rod 65 of the automatic gas supply valve mechanism 63, thereby adjusting the gas sealing pressure of the gas chamber 61*b* so as to be increased. Moreover, when the diaphragm 62 for suppressing pulsation is contractibly deformed in the direction wherein the capacity of the liquid chamber is decreased so as to be below the standard value S, thereby exceeding a predetermined range B, the automatic gas exhaust valve mechanism 64 opens the gas exhaust port 68 by means of a slider 67 abutting against an closed end portion 62*a* of the diaphragm 62 for suppressing pulsation. As a result, the gas inside the gas chamber 61*b* is exhausted and adjusted so as to decrease the gas sealing pressure.

On the other hand, a pulsation suppression device for a pump disclosed in Japanese Patent Publication Laying-open No. 8-159016 is shown in FIG. 5A. A switching valve mechanism for switching between gas supply and gas exhaust is shown in FIG. 5B. The proposed device adopts a gas chamber internal pressure adjusting valve mechanism for restricting the change of the capacity of the liquid chamber 61*a* disposed in the same way as the liquid chamber 61*a* disclosed in Japanese Patent Publication Laying-open No. 6-17752 so as to be within the predetermined range of the displacement of the capacity. In the mechanism, the switching valve mechanism for switching between gas supply and gas exhaust having an operating rod 69 and a slide valve element 71 is protrusively fitted on an outer side of the device body casing 60. The operating rod 69 is operated according to a displacement of the closed end side 62*a* of the diaphragm 62 for suppressing pulsation. The slide valve element 71 makes a gas supply and exhaust passage 70 for using both gas supply and gas exhaust, alternatively connect to the gas supply port 66 and the gas exhaust port 68. The gas supply and exhaust passage 70 is operated by the operating rod 69 so as to communicate with the gas chamber 61*b*. The valve mechanism has the structure as below. The valve mechanism makes the gas supply port 66 connect to the gas supply and exhaust passage 70 when the capacity of the liquid chamber 61*a* is increased so as to be above the predetermined range. The valve mechanism makes the gas exhaust port 68 connect to the gas supply and exhaust passage 70 when the capacity of the liquid chamber 61*a* is decreased so as to be below the predetermined range. It has a cylindrical casing 72 provided with the gas supply and exhaust passage 70 which communicates with the gas supply port 66, the gas exhaust part 68, and the gas chamber 61*b,* and the slide valve element 71 which is coaxially coupled to the operating rod 69 so as to be slidably and displaceably engaged with the inside of the cylinder 73 housed inside the cylindrical casing 72.

Among the two prior arts mentioned above, the device disclosed in the former one, i.e., Japanese Patent Publication Laying-open No. 6-17752, has a structure wherein the automatic gas supply valve mechanism 63 and the automatic gas exhaust valve mechanism 64 are integrally formed with the lower side member 60*a* as an element of the device body casing 60. Therefore, when either of valve mechanisms 63, 64 is damaged or destroyed, it is necessary to disassemble and repair the device body or replace a whole of the body. This requires much labor, thereby resulting in disadvantage in maintenance and cost. Moreover, the gas exhaust port 68 of the automatic gas exhaust valve mechanism 64 is structurally confined by a phenomenon wherein a gas exhaust valve element 75 drops owing to its weight. Therefore, the closing action is unstable, and the device must be installed so as to keep vertical arrangement relationship between the gas exhaust valve element 75 and the gas exhaust port 68. For example, it cannot be allowed that the device is installed so that the gas exhaust valve element 75 may be horizontally arranged. As a result, kinds of the device are restricted.

The switching valve mechanism for switching between gas supply and gas exhaust disclosed in Japanese Patent Publication Laying-open No. 8-159016, i.e., the latter one, adopts a configuration wherein one valve is used for both the gas supply and the gas exhaust. Therefore, it is not necessary to disassemble the device body. It is efficient only to disassemble the switching valve mechanism and repair or replace it. In case of closing the gas supply port 66 and the gas exhaust port 68, this does not structurally rely on the weight of the gas exhaust valve element 75, which is different from the former one, thereby making it possible to overcome the problem in the former one. However, on the other hand, it has disadvantages as below. The structure of the switching valve is very complicated, the seal of the slide valve element 71 is so difficult, and it protrudes to the outside of the device body casing 60, whereby a whole of the device is bulky and large-sized.

The present invention has been conducted in view of the above mentioned circumstances. Especially, an object of the present invention is to provide a pulsation damping device for a pump, which can be installed in either vertical or horizontal style by improving the gas exhaust valve mechanism. This can diversify kinds of the device.

Moreover, another object of the present invention is to provide the pulsation damping device for a pump whose structure is simple, which can be economically produced, and wherein it is easy to maintain the gas supply and exhaust valves.

DISCLOSURE OF THE INVENTION

A pulsation damping device for a pump according to the present invention comprises:

a hermetical device body casing having a liquid chamber for supplying a transported liquid to be transported by a reciprocal pump, from an inflow passage, temporarily storing the transported liquid, and discharging it from an outflow passage, and a gas chamber to be filled with a gas for suppressing pulsation, a pulsation suppression diaphragm for suppressing pulsation, which partitions an interior of said device body casing into the liquid chamber and the gas chamber, and which can freely reciprocate according to a balance between each fluctuation of flowing amount and pressure of the transported liquid and a gas sealing pressure inside the gas chamber, a gas pressure supply means for supplying the gas chamber with a gas pressure, a gas supply port for guiding the gas pressure from the gas pressure supply means to an inside of the gas chamber when the gas sealing pressure inside the gas chamber is raised, a gas exhaust port for exhausting the gas from the gas chamber to the outside thereof when the gas sealing pressure inside the gas chamber is lowered, an automatic gas supply valve mechanism for usually closing the gas supply port, an automatic gas exhaust valve mechanism for usually closing the gas exhaust port, a valve press rod disposed between the automatic gas supply valve mechanism and the pulsation suppression diaphragm, which is actuated so as to open usually the gas supply port when the pulsation suppression diaphragm is moved beyond a predetermined stroke in the direction of expanding the liquid chamber, and a slider disposed between the automatic gas exhaust valve mechanism and the pulsation suppression diaphragm, which is actuated so as to open usually the gas exhaust port when the pulsation suppression diaphragm is moved beyond a predetermined stroke in the direction of reducing the liquid chamber. Moreover, in the pulsation damping device for a pump having the above-mentioned structure, the automatic gas exhaust valve mechanism includes:

a gas exhaust valve rod loosely inserted in a through hole of a spring receiving member fixed in the device body casing, so as to form a space, a gas exhaust valve element disposed on a tip of the gas exhaust valve rod, which can freely touch or separate from a valve seat of the gas exhaust port, and the slider arranged at an rear end of the gas exhaust valve rod so as to be slidable in an axial direction of the valve, a spring for a closing state is disposed between the gas exhaust valve element and the spring receiving member, and a spring for an opening state is disposed between the gas exhaust valve element and the slider.

According to the pulsation damping device having the above structure, when the capacity of the liquid chamber is increased so as to exceed the predetermined range by means of fluctuation of the discharge pressure in the reciprocal pump, the automatic gas supply valve mechanism makes the gas supply to the inside of the gas chamber, thereby raising the sealing pressure. This restricts extendable deformation of the pulsation suppression diaphragm. When the capacity of the liquid chamber is decreased so as to exceed the predetermined range, the automatic gas exhaust valve mechanism makes gas exhaust from the inside of the gas chamber, thereby lowering the sealing pressure. This restricts the contractible deformation of the pulsation suppression diaphragm. In spite of the fluctuation of the discharge pressure of the reciprocal pump, the extendable and contractible deformation amount of the pulsation suppression diaphragm is restricted within a predetermined range, thereby keeping the range of the pulsation small. Furthermore, in the automatic gas exhaust valve mechanism, the spring for a closing state functions so that the gas exhaust valve element may close compulsorily the gas exhaust port. Therefore, the gas exhaust port can be stably and surely closed. Moreover, even if the device is installed in either vertical style or horizontal style so that the gas exhaust valve element may be vertically or horizontally arranged, it never adversely affects the closing action of the gas exhaust port.

According to the pulsation damping device of a pump according to another invention, the device body casing is provided with an aperture for communicating with the gas chamber, and a valve case is detachably engaged with an inside of the aperture, the valve case is provided with the gas supply port, the gas exhaust port, the automatic gas supply valve mechanism, the valve press rod, the slider, the gas exhaust valve element of the automatic gas exhaust valve mechanism, the exhaust valve rod, the spring receiving member, the spring for a closing state, and the spring for an opening state.

In the pulsation damping device of a pump having the above structure, even if either the automatic gas supply valve mechanism or the automatic gas exhaust valve mechanism is damaged or destroyed, it can be easily repaired or replaced by pulling out only the valve case from the aperture. In other words, it has an advantage in maintenance aspect. Furthermore, the automatic gas supply valve mechanism and the automatic gas exhaust valve mechanism are independently disposed inside one valve case, so as to be parallel with each other. Thus, the structure of the valve is simple and it can be economically produced. The valve case is engaged with an inside of the aperture so as to be housed in a compact state, without protruding outwardly from the device body casing.

Additionally, according to the pulsation damping device for a pump according to a still another invention, the device body casing is integrally provided with an air-driving type reciprocal pump, the air-driving type reciprocal pump includes a diaphragm for a pump, which can be extendably and contractibly deformed in an extending and contracting direction of the pulsation suppression diaphragm, an air cylinder portion for driving the diaphragm for a pump so as to be extendably and contractibly deformed, and a pump working chamber disposed inside the diaphragm for a pump, the pump working chamber having suction and discharge check valves for sucking and discharging the transported liquid, the check valves being alternately opened and closed in accordance with extendable and contractible deformation of the diaphragm for a pump, and the transported liquid discharged from the pump working chamber via a discharge check valve is fed to the liquid chamber.

According to the pulsation damping device for a pump having the above structure, when the diaphragm for a pump is moved so as to be extendably and contractibly deformed via the air cylinder portion, the suction check valve 16*a* and the discharge check valve 16*b* inside the pump working chamber are alternately opened and closed. As a result, suction of the transported liquid from the inflow passage to the pump working chamber and discharge of it from the inside of the pump working chamber to the outflow passage are repeated, thereby performing the predetermined pump action. At this time, the transported liquid discharged from the pump working chamber through the discharge check valve is discharged to the outflow passage through the liquid chamber of the pulsation damping device. At this time, in a peak of the pulsation of the discharge pressure of the discharged liquid, the pulsation suppression diaphragm is moved in the direction of increasing the capacity of the liquid chamber, so as to absorb the pressure. In a valley of the pulsation, the pulsation suppression diaphragm is moved in a direction wherein the capacity of the liquid chamber is decreased, the pressure of the discharged liquid is raised so as to absorb the pulsation, thereby making it possible to discharge continuously and smoothly the transported liquid without pulsation. The reciprocal pump is integrally formed with the pulsation damping device. In other words, it does not require an external piping for connecting therebetween. Additionally, this can reduce costs, downsize a whole of the device, and attain reduction of the installation space. The external piping can be omitted. Consequently, there is no fear wherein the piping is broken thereby causing leakage of the liquid, even if it has been used for a long time. Furthermore, loss of the pressure is extremely small. This allows the capacity of the pump to be small, and makes the pump itself compact, thereby making it possible to minimize an occupied area for installing the pump.

In addition, according to the pulsation damping device for a pump according to a further another invention, a stopper is disposed on an end on a side of the gas chamber of the valve case, and the stopper restricts further movement of the pulsation suppression diaphragm when the pulsation suppression diaphragm moves in the direction of expanding the liquid chamber so as to be beyond a predetermined stroke and the valve press rod is actuated.

According to the pulsation damping device for a pump having the above-mentioned structure, the excessive extendable deformation of the pulsation suppression diaphragm can be restricted, thereby preventing the damage of the pulsation suppression diaphragm.

BEST MODES FOR CARRYING OUT THE INVENTION

Figure 1:
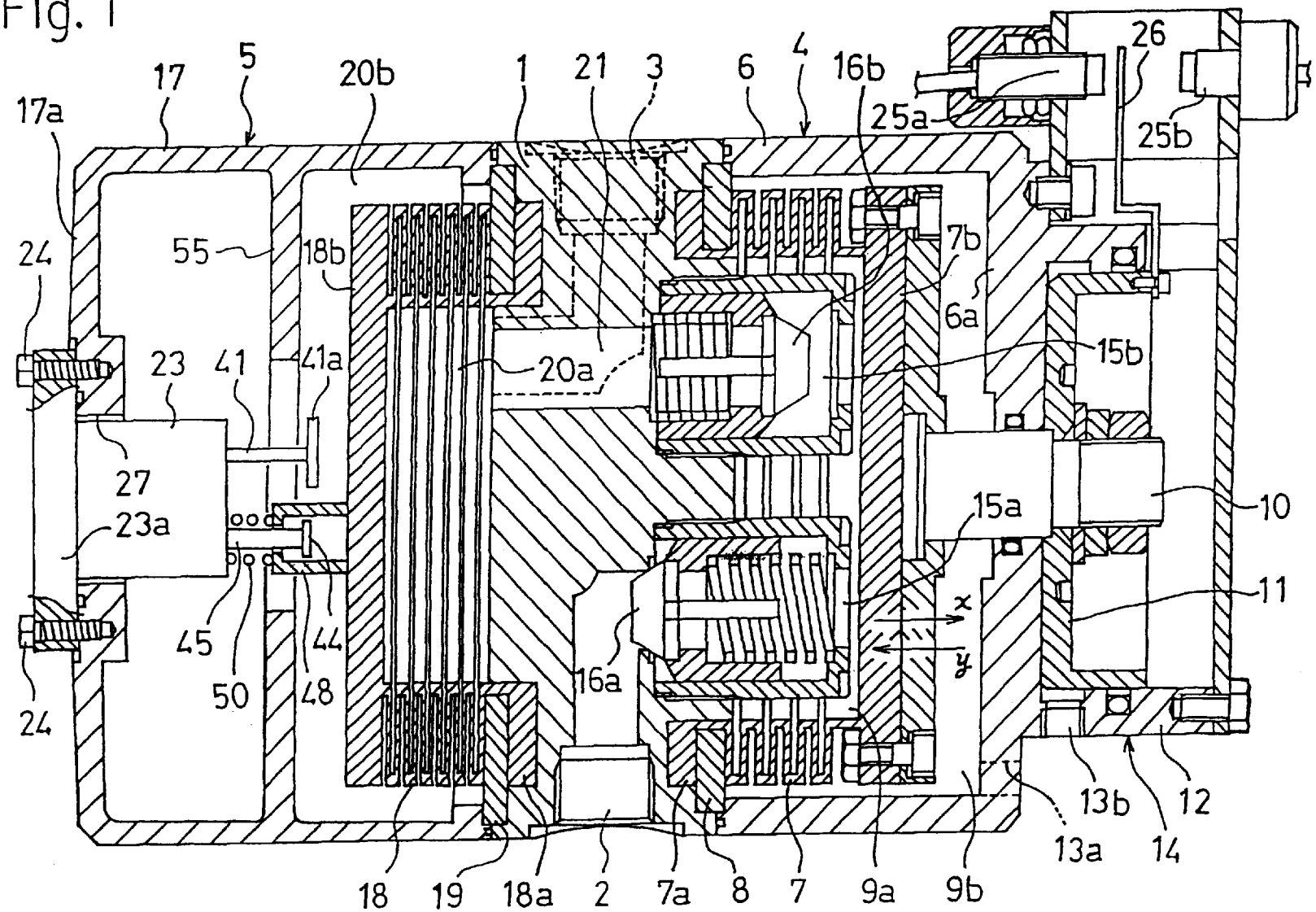
FIG. 1 is a longitudinal sectional front view of a whole of a pulsation damping device for a pump according to the present invention.
Figure 2:
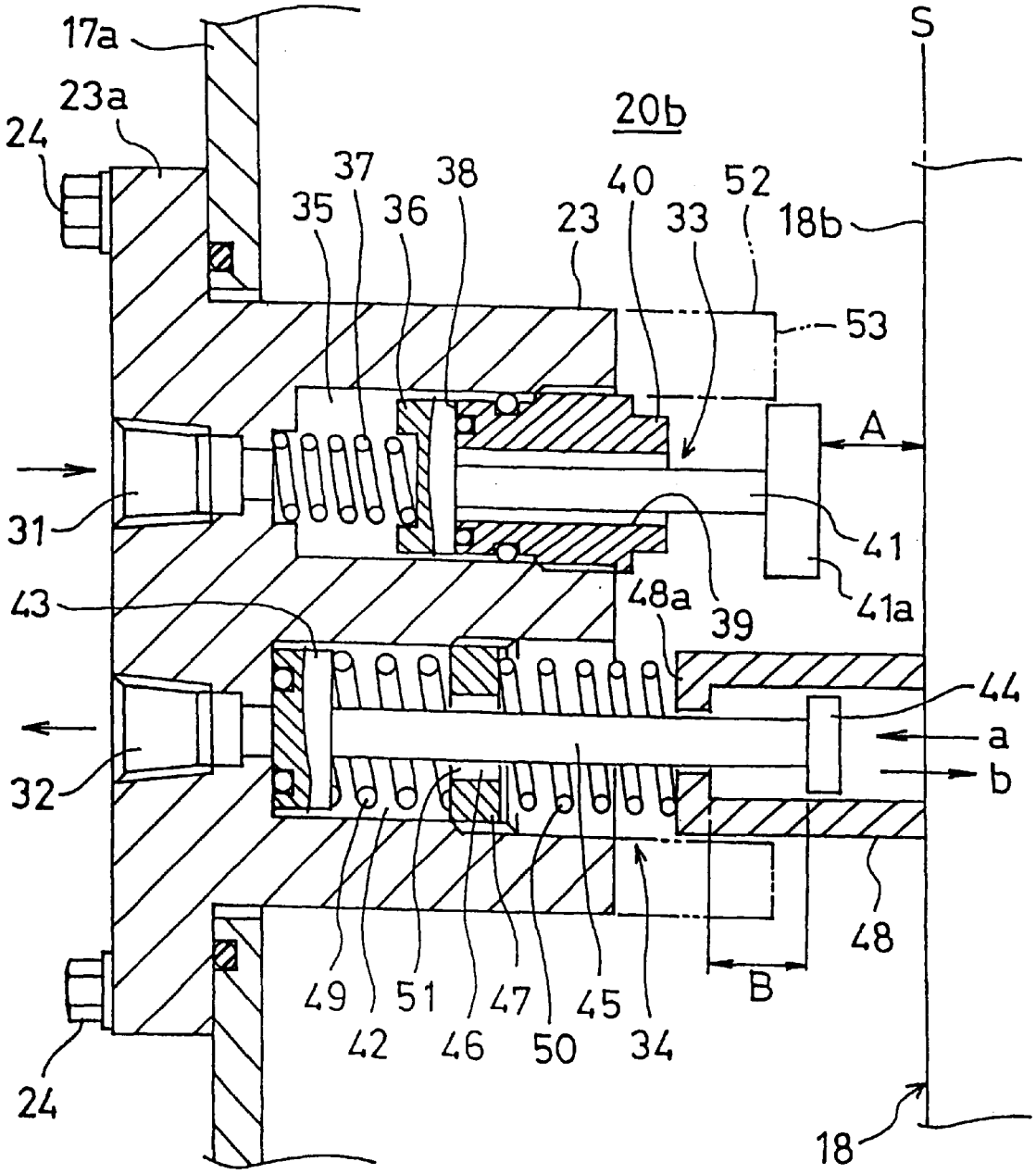
FIG. 2 is an enlarged longitudinal sectional front view of an automatic gas supply valve mechanism and an automatic gas exhaust valve mechanism of the same pump.

FIG. 1 is a whole longitudinal sectional front view of a pulsation damping device for a pump in case of applying the pulsation damping device to an air driving type bellows pump for semiconductor producing device. FIG. 2 is an enlarging longitudinal sectional front view of a set of an automatic gas exhaust valve mechanism and an automatic gas supply valve mechanism. In FIG. 1, 1 designates a partition wall of a device body having an inflow passage 2 and an outflow passage 3 of a liquid to be transported by a pump, a reciprocal pump 4 and a pulsation damping device 5 which are opposed to each other, are disposed on both sides of the partition wall 1 so as to be integrated with the partition wall 1.

A bottomed cylindrical pump casing 6 is connectedly disposed on a side of the partition wall 1. Inside the pump casing 6, a bottomed cylindrical diaphragm 7 for a pump, being a bellows or a diaphragm, which is extendably and contractibly deformed is (i.e., shown as a bellows in this figure) disposed along the axial direction of the cylindrical portion. An opening peripheral portion 7*a* of the diaphragm 7 for a pump is hermetically pressed against a side surface of the partition wall 1 and fixed thereto by an annular fixing plate 8. Therefore, an inside space of the pump casing 6 is hermetically partitioned into a pump working chamber 9*a* inside the diaphragm 7 for a pump and a pump operating chamber 9*b* outside the diaphragm 7 for a pump.

A cylindrical body 12 is fixed to an outside of a bottom wall 6*a* of the pump casing 6. The cylindrical body 12 houses slidably a piston 11 fixedly connected to a closed end member 7*b* of the diaphragm 7 for a pump, via a coupling member 10. An air cylinder portion 14 is disposed outside the pump casing 6. Through air holes 13*a*, 13*b* formed on the cylindrical body 12 and the bottom wall 6*a* of the pump casing 6, pressurized air fed from a pressurized air feeding device such as a compressor (not shown) is supplied to an inside of the cylindrical body 12 or the pump operating chamber 9*b*. As a result, the air cylinder portion 14 drives the diaphragm 7 for a pump so as to be extendably and contractibly deformed. The air cylinder portion 14 is provided with adjacent sensors 25*a*, 25*b*. On the other hand, the piston 11 is provided with a sensor detecting plate 26. The sensor detecting plate 26 alternately approaches 25*a* and 25*b* in accordance with reciprocation of the piston 11, whereby supply of the pressurized air fed from the pressurized air feeding device to the inside of the cylindrical body 12 and supply thereof from the pressurized air feeding device to the pump operating chamber 9*b* are automatically switched.

Moreover, a sucking mouth 15*a* and a discharging mouth 15*b* formed so as to open each mouth to the pump working chamber 9*a* respectively communicate with the inflow passage 2 and outflow passage 3. The sucking mouth 15*a* and the discharging mouth 15*b* are respectively provided with a suction check valve 16*a* and a discharge check valve 16*b*. The check valves are alternately opened and closed in accordance with extendable and contractible deformation caused by driving the diaphragm 7 for a pump. The pump 4 comprises the above elements.

On the other hand, a bottomed cylindrical device body casing 17 is disposed on another side of the partition wall 1 so as to be coaxial with the pump casing 6. Also, a bottomed cylindrical pulsation suppression diaphragm 18 for suppressing pulsation (shown as the bellows in this figure) is disposed inside the device body casing 17, so as to be opposed to the diaphragm 7 for a pump in the pump 4. The pulsation suppression diaphragm 18 is a bellows or diaphragm which is extendably and contractibly deformable along the axial direction of the cylindrical portion. An opening peripheral edge 18*a* of the pulsation suppression diaphragm 18 is hermetically and pressingly fixed to another side surface of the partition wall 1 by an annular fixing plate 19, whereby the inside space of the device body casing 17 is partitioned into a liquid chamber 20*a* and a gas chamber 20*b*. The liquid chamber 20*a* is for temporarily storing a liquid to be discharged via the discharge check valve 16*b* and a communication passage 21 formed by piercing the thickness of the partition wall 1, and the gas chamber 20*b* is filled with an air for decreasing pulsation.

By the above-mentioned elements, the pulsation damping device 5 is configured, wherein the pulsation caused by a discharging pressure of a liquid to be discharged from the pump working chamber 9*a* is absorbed and damped by a change of capacity of the liquid chamber 20*a* in accordance with the extendable and contractible deformation of the pulsation suppression diaphragm 18.

An aperture 27 is formed in the neighborhood of the center of the outer surface of a bottom wall 17*a* of the device body casing 17. A valve case 23 with a flange 23*a* is engaged with an inside of the aperture 27, and the flange 23*a* is pressingly fixed to the outside of the bottom wall 17*a* via bolt 24 or the like, so as to be detachable.

As shown in FIG. 2, the valve case 23 is provided with a gas supply port 31 and a gas exhaust port 32 which are parallel with each other. The gas supply port 31 has an automatic gas supply valve mechanism 33 for raising a sealing pressure inside the gas chamber 20*b* by supplying the air pressurized above the maximum pressure value of the transported liquid to the gas chamber 20*b* when the capacity of the liquid chamber 20*a* exceeds a predetermined range so as to be increased. The gas exhaust port 32 is provided with an automatic gas exhaust valve mechanism 34 for lowering a sealing pressure inside the gas chamber 20*b* when a capacity of the liquid chamber 20*a* exceeds a predetermined range so as to be decreased.

The automatic gas supply valve mechanism 33 includes a gas supply valve chamber 35 formed on the valve case 23 so as to communicate with the gas supply port 31, a gas supply valve element 36 for opening and closing the gas supply port 31, which is slidable along the axis inside the gas supply valve chamber 35, a spring 37 for usually urging the gas supply valve element 36 to a close position, and a valve seat 38 of the gas supply valve element 36 in the inner end portion thereof. Furthermore, the automatic gas supply valve mechanism 33 includes a through hole 39 for making the gas supply chamber 35 communicate with the gas chamber 20*b*, a guide member 40 screwed and fixed on the valve case 23, and a valve press rod 41 slidably inserted in the through hole 39 of the guide member 40. Under the condition wherein the pressure of liquid inside the liquid chamber 20*a* is set at an average pressure, and the pulsation suppression diaphragm 18 is located in a standard position S, the gas supply valve element 36 is closely fitted to the valve seat 38 of the guide member 40, so as to close the gas supply port 31. Moreover, under the condition, the end portion 41*a* facing the inside of the gas chamber 20*b* of the valve press rod 41 is distant from a closed end portion 18*b* of the pulsation suppression diaphragm 18, so as to keep the space of a stroke A.

The automatic gas exhaust valve mechanism 34 includes a gas exhaust valve chamber 42 formed on the valve case 23 so as to communicate with the gas exhaust port 32, a gas exhaust valve element 43 for opening and closing the gas exhaust port 32, which is slidable along the axis inside the gas exhaust valve chamber 42, a gas exhaust valve rod 45 having the gas exhaust valve element 43 on the front end thereof and a flange portion 44 on the rear end thereof respectively, a spring receiving member 47 having a through hole 46, which is screwingly fixed to the inside of the valve chamber 42 and in which the gas exhaust valve rod 45 is inserted, a cylindrical slider 48 in which a rear end of the gas exhaust valve rod 45 is slidably inserted, and which prevents the gas exhaust valve rod 45 from slipping off, a spring 49 for a closing state, disposed between the gas exhaust valve element 43 and the spring receiving member 47, and a spring 50 for an opening state, disposed between the spring receiving member 47 and an closed end portion 48*a* of the slider 48. A internal diameter of the through hole 46 of the spring receiving member 47 is greater than the axial diameter of the gas exhaust valve rod 45. Through a space 51 formed therebetween, the gas exhaust valve chamber 42 communicates with the gas chamber 20*b*. Under the condition wherein the pulsation suppression diaphragm 18 is located in a standard position S, the gas exhaust valve element 43 closes the gas exhaust port 32, and the flange portion 44 of the rear end of the gas exhaust valve rod 45 is apart from the inside of the closed end portion 48*a* of the slider 48, so as to keep the space of a stroke B.)

The end on a side of the diaphragm, in the valve case 23, is extended in a direction of the inside of the gas chamber 20*b*, as shown phantom lines 52 in FIG. 2. A stopper 53 may be disposed on an end position of the extension. The stopper 53 restricts a further movement of the pulsation suppression diaphragm 18, when the diaphragm 18 moves in a direction of expanding the liquid chamber 20*a* so as to be beyond a determined stroke A, thereby actuating the valve press rod 41. In this case, a stopper wall 55 (shown in FIG. 1) protrusively formed from the inside of the device body casing 17 to the gas chamber 20*b*, which has the same object as that of the stopper 53, may be omitted.

Next, action of the pulsation damping device for a pump having the above configuration will be described.

The pressurized air fed from the pressurized air feeding device such as a compressor (not shown) is supplied to the inside of the cylindrical body 12 of the air cylinder portion 14 via the air hole 13*b*. The piston 11 and the coupling member 10 are displaced in the x direction of FIG. 1. As a result, the diaphragm 7 for a pump is extended in the x direction of FIG. 1, whereby the transported liquid inside the inflow passage 2 is sucked inside the pump working chamber 9*a* via the suction check valve 16*a*. When the pressurized air is supplied to the inside of the pump operating chamber 9*b* of the air cylinder portion 14 via the air hole 13*b*, and is exhausted from the air hole 13*b* so as to contract the diaphragm 7 for a pump in the y direction of FIG. 1, the transported liquid which has been sucked into the inside of the pump working chamber 9*a*, is discharged via the discharge check valve 16*b*. Thus, the diaphragm 7 for a pump in the reciprocal pump 4 is driven via the air cylinder portion 14, so as to be deformed by extension and contraction, thereby alternately opening and closing the suction check valve 16*a* and the discharge check valve 16*b*. Consequently, suction of the transported liquid from the inflow passage 2 to the pump working chamber 9*a* and discharge of it from the inside of the pump working chamber 9*a* to the outflow passage 3 are repeated, thereby performing the predetermined pump action. When the transported liquid is fed to the predetermined portion by the above-mentioned action of the reciprocal pump 4, the pump discharge pressure causes pulsation owing to repetitions of a peak and a valley.

The transported liquid discharged from the inside of the pump working chamber 9*a* in the pump 4 via the discharge check valve 16*b* is supplied to the inside of the liquid chamber 20*a* in the pulsation damping device 5 via the communication passage 21. After the transported liquid is temporarily stored inside the liquid chamber 20*a,* it flows in the outflow passage 3. Then, when the discharge pressure of the transported liquid shows the peak of a discharge pressure curve, the pulsation suppression diaphragm 18 is extendably and contractibly deformed by the transported liquid so as to increase the capacity of the liquid chamber 20*a,* thereby absorbing the pressure. At this time, a flow amount of the transported liquid flowing out from the liquid chamber 20*a* is less than that of the transported liquid fed from the reciprocal pump 4.

Moreover, when the discharge pressure of the transported liquid comes to the valley portion of the discharge pressure curve, the pressure of the transported liquid is lower than a sealing pressure of the inside of the gas chamber 20*b,* which is compressed according to the extendable deformation of the pulsation suppression diaphragm 18. Therefore, the pulsation suppression diaphragm 18 is contractibly deformed. At this time, the flow amount of the transported liquid flowing out from the liquid chamber 20*a* is more than that of the transported liquid flowing in the inside of the liquid chamber 20*a* from the reciprocal pump 4. The repeating action, i.e., the pulsation caused by the change of the capacity of the liquid chamber 20*a* is absorbed and damped.

By the way, when, in the above-mentioned action, the discharge pressure for discharging it from the reciprocal pump 4 rises, the capacity of the liquid chamber 20*a* is increased by the transported liquid so that the pulsation suppression diaphragm 18 is remarkably extendably deformed. When an amount of extendable deformation of the pulsation suppression diaphragm 18 exceeds a predetermined range A, the closed end portion 18*b* of the pulsation suppression diaphragm 18 presses the valve press rod 41 in the direction of the inside of the valve chamber. As a result, the gas supply valve element 36 in the automatic gas supply valve mechanism 33 is opened into the spring 37, and the high air pressure is supplied to the gas chamber 20*b* through the gas supply port 31, thereby raising the sealing pressure inside the gas chamber 20*b*. This restricts the amount of the extendable deformation of the pulsation suppression diaphragm 18 so that it may not exceed the stroke A, thereby restraining an excessive increase of the capacity of the liquid chamber 20*a*. At this time, when the stopper 53 is disposed on the end on a side of the diaphragm, in the valve case 23, the closed end portion 18*b* of the pulsation suppression diaphragm 18 abuts against the stopper 53, thereby ensuring the prevention of the excessive extendable deformation of the pulsation suppression diaphragm 18. It is advantageous from a point of view of prevention for damage thereof. The pulsation suppression diaphragm 18 is contracted in the direction of the standard position S in accordance with a rise of the sealing pressure inside the gas chamber 20*b*. Therefore, the valve press rod 41 is distant from the closed end portion 18*b* of the pulsation suppression diaphragm 18, whereby the gas supply valve element 36 return to a closing position so as to keep the sealing pressure inside the gas chamber 20*b* in an adjusting state.

On the other hand, when the discharge pressure from the reciprocal pump 4 is lowered, the capacity of the liquid chamber 20*a* is decreased, whereby the pulsation suppression diaphragm 18 is extremely contractibly deformed. When an amount of contractible deformation of the pulsation suppression diaphragm 18 exceeds a predetermined range B, the slider 48 of the automatic gas exhaust valve mechanism 34 is moved in the contracting direction b of the pulsation suppression diaphragm 18 in accordance with movement of the closed end portion 18*b* of the pulsation suppression diaphragm 18 in the contracting direction b, owing to an urging action of the spring 50 for an opening state, whereby the inside of the closed end portion 48*a* of the slider 48 is engaged with the flange portion 44 of the gas exhaust valve rod 45. Thus, the gas exhaust valve rod 45 moves in the direction b and the gas exhaust valve element 43 opens the gas exhaust port 32, so that the air sealed inside the gas chamber 20*b* is exhausted from the gas exhaust port 32 to the atmosphere, thereby decreasing the sealing pressure inside the gas chamber 20*b*. Therefore, the amount of contractible deformation of the pulsation suppression diaphragm 18 is restricted so as not to exceed the stroke B. This prevents the capacity of the liquid chamber 20*a* from being excessively decreased. In accordance with decrease of the sealing pressure inside the gas chamber 20*b,* the pulsation suppression diaphragm 18 is extended to the standard position S, whereby the slider 48 is pressed by the closed end portion 18*b* of the pulsation suppression diaphragm 18. As a result, while the slider 48 is moved in the direction a, the spring 50 for an opening state is compressed, and the gas exhaust valve element 43 closes the gas exhaust port 32 once more owing to the urging action of the spring 49 for a closed state. This keeps the sealing pressure inside the gas chamber 20*b* in the adjusting state. As a result, in spite of fluctuation of the discharge pressure from the pump working chamber 9*a* of the reciprocal pump 4, the pulsation is effectively absorbed so as to keep the range of the pulsation small.

Figure 3:
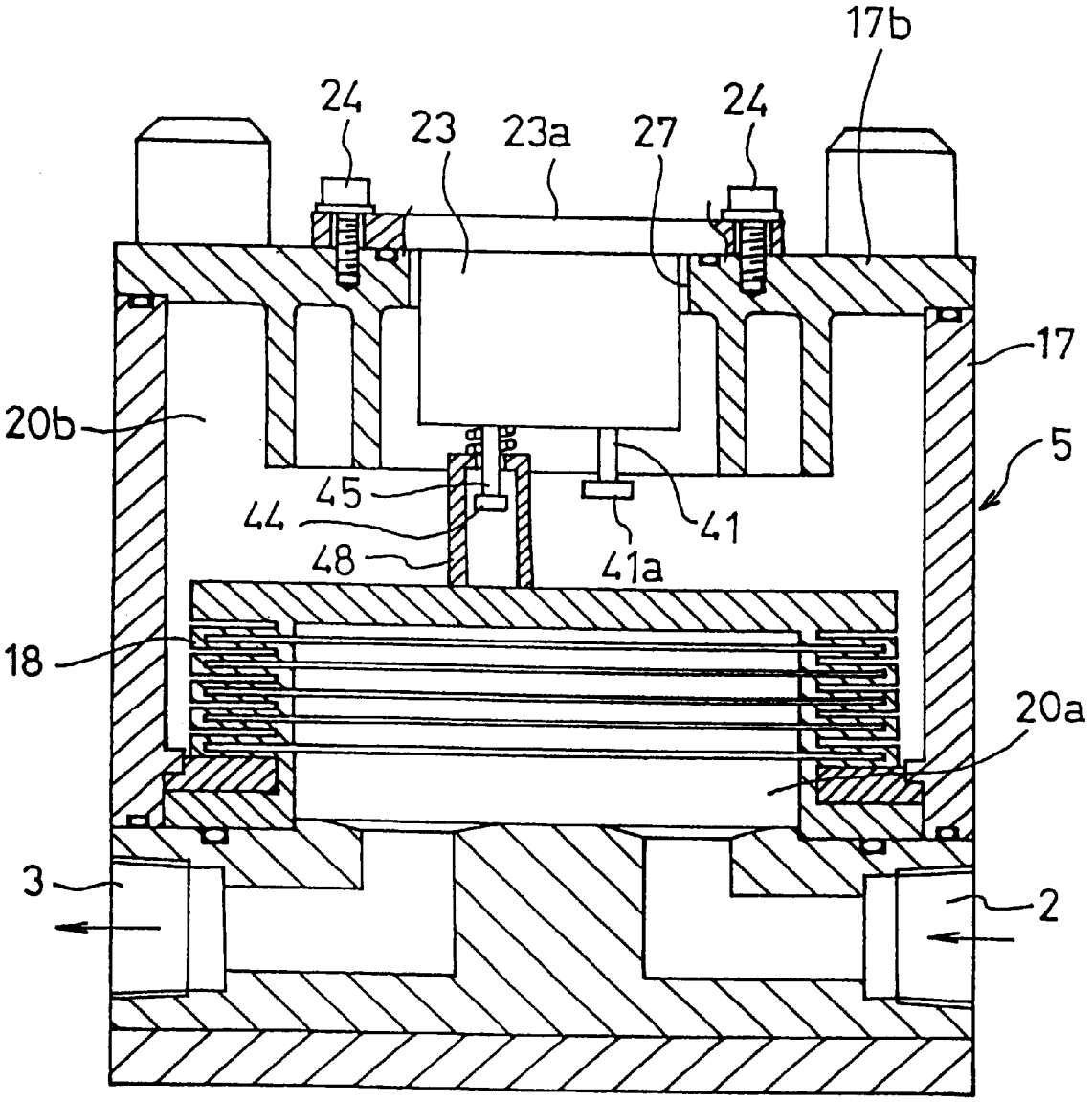
FIG. 3 is a longitudinal sectional front view of a whole of the pulsation damping device for a pump according to the another embodiment.
Figure 4:
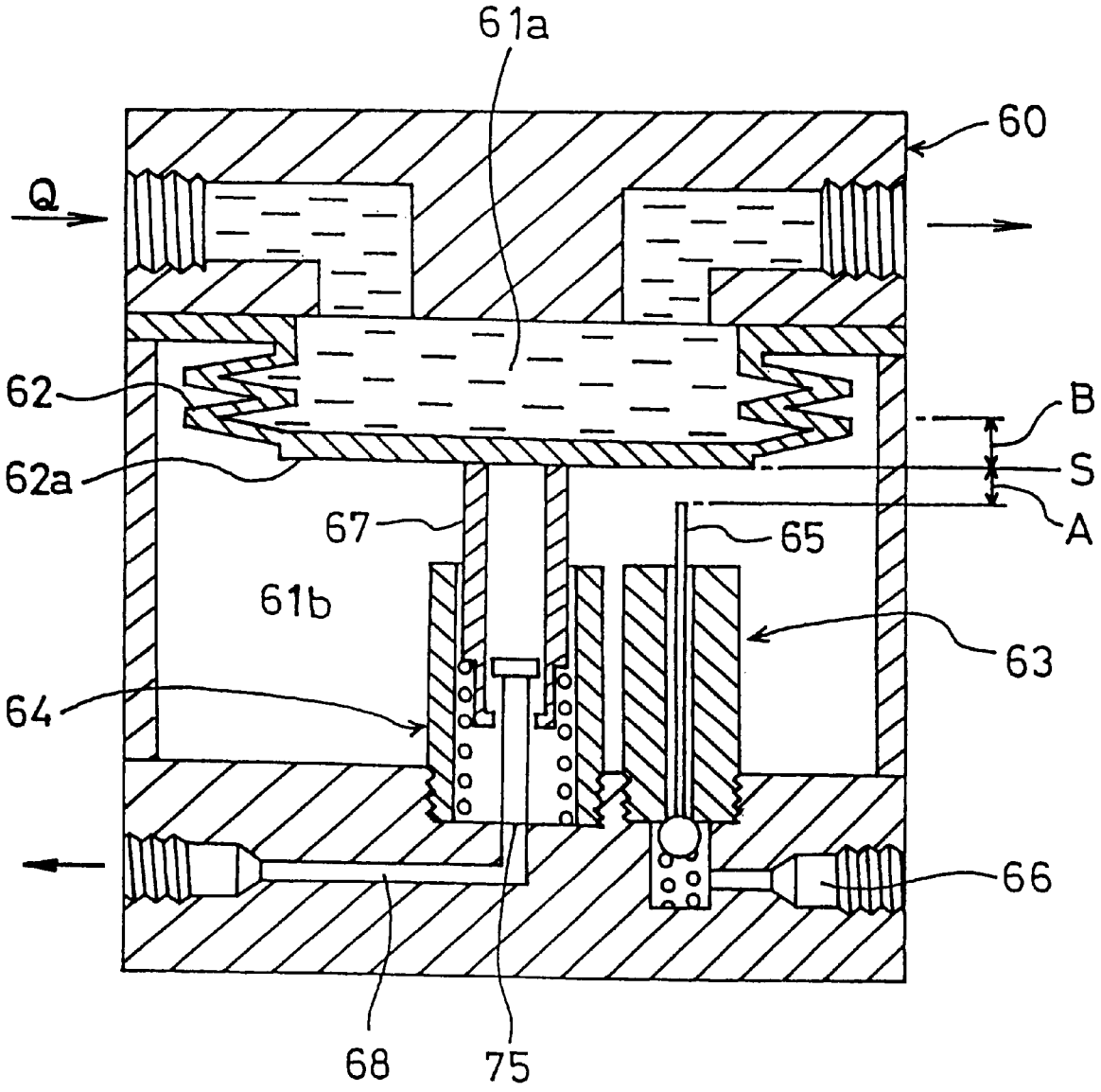
FIG. 4 is a longitudinal sectional front view of a whole of a pulsation damping device for a pump according to a prior art.
Figure 5A:
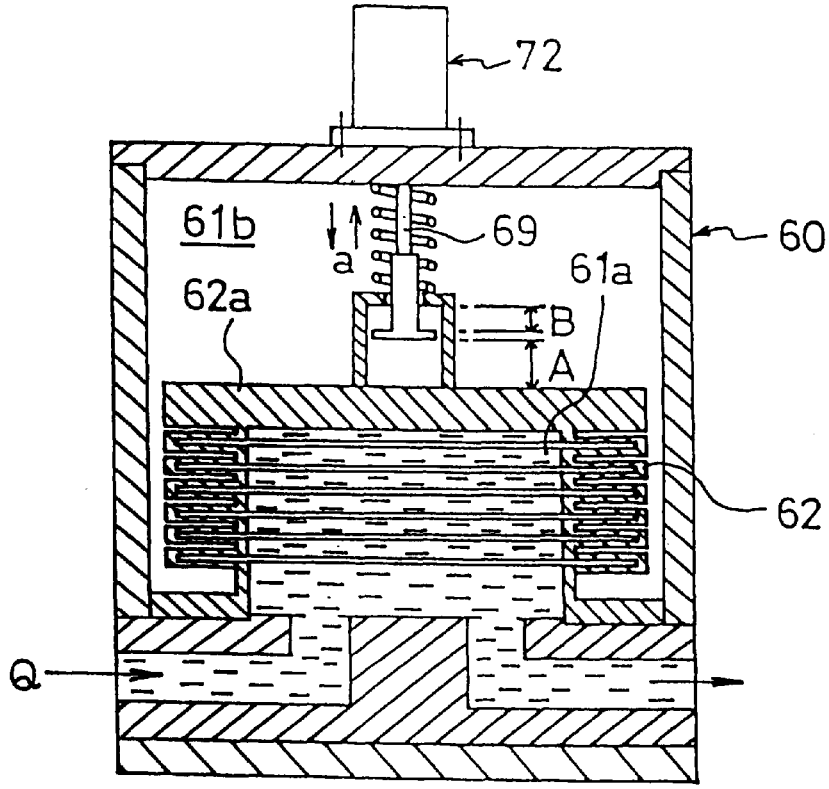
FIG. 5A is a longitudinal sectional front view of a whole of a pulsation damping device for a pump according to another prior art.
Figure 5B:
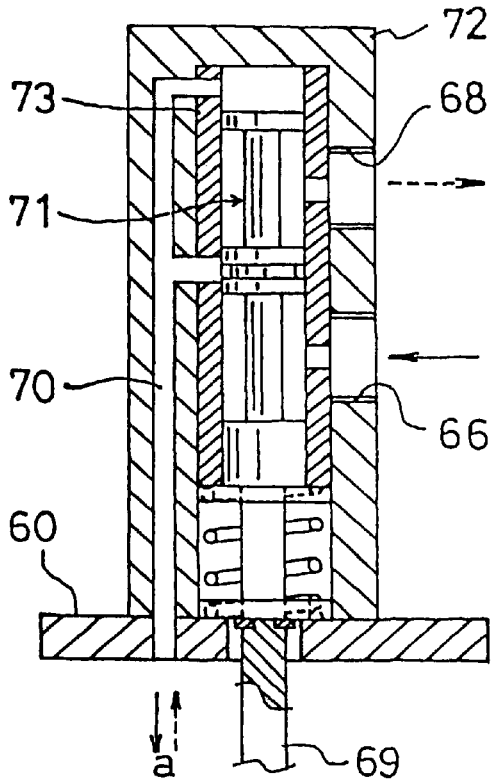
FIG. 5B is an enlarged longitudinal sectional front view of a switching valve mechanism for switching between gas supply and gas exhaust, of the pump of FIG. 5A.

FIG. 3 is a whole longitudinal front view of the pulsation damping device for a pump, illustrating another embodiment of the present invention. In the embodiment, the pulsation damping device 5 as an accumulator is independently separated from the pump, and individually configured. On a side of the lower portion of the hermetical device body casing 17, the liquid chamber 20*a* is disposed, so that the transported liquid fed from the pump (not shown) installed in another position is sucked from the inflow passage 2 to the inside of the liquid chamber 20*a,* and temporarily stored therein until it discharges from the outflow passage 3. On a side of the upper portion of the inside of the device body casing 17, the gas chamber 20*b* is disposed. The liquid chamber 20*a* is separated from the gas chamber 20*b* by the pulsation suppression diaphragm 18. The valve case 23 is fitted on the aperture 27 of the upper wall 17*b* of the device body casing 17 by the bolts 24 or the like so as to be detachably engaged therewith. The valve case 23 has the same automatic gas supply valve mechanism 33 and the same automatic gas exhaust valve mechanism 34 as those described in the above embodiment. Each of the pulsation damping device 5, the automatic gas supply valve mechanism 33 and the automatic gas exhaust valve mechanism 34 has the same configuration and action as those of the preceding embodiment. Therefore, the description thereof is omitted.

INDUSTRIAL APPLICABILITY

The invention according to claim 1 makes it possible to absorb and damp the pulsation of the reciprocal pump, and to keep increase or decrease of the capacity of the liquid chamber within a predetermined range, by means of a pressure balance between the liquid pressure and the gas pressure, and effectively absorb the pulsation, thereby keeping the range of pulsation small. Moreover, the present device can be installed in any attitude, namely either horizontally or vertically.

The invention according to claim 2 makes it easy to perform maintenance of each of the gas supply valve and the gas exhaust valve, and the structure thereof is so simple that it is economically produced.

According to the invention of claim 3, the reciprocal pump is integrated with the pulsation damping device, thereby downsizing a whole of the device, and attaining greatly reduction of the installation space.

According to the invention of claim 4, the excessive extendable deformation is suppressed, thereby preventing damage of the pulsation suppression diaphragm.

What is claimed is:

1. A pulsation damping device for a pump, comprising:

a hermetical device body casing having a liquid chamber for supplying a transported liquid to be transported by a reciprocal pump from an inflow passage, temporarily storing the transported liquid, and discharging it to an outflow passage, and a gas chamber to be filled with a gas for suppressing pulsation, a pulsation suppression diaphragm for suppressing pulsation, which partitions an interior of said device body casing into the liquid chamber and the gas chamber, and which can freely reciprocate according to a balance between each fluctuation of flowing amount and pressure of the transported liquid and a gas sealing pressure inside the gas chamber, a gas pressure supply means for supplying the gas chamber with a gas pressure, a gas supply port for guiding the gas pressure from the gas pressure supply means to an inside of the gas chamber when the gas sealing pressure inside the gas chamber is raised, a gas exhaust port for exhausting the gas from the gas chamber to the outside thereof when the gas sealing pressure inside the gas chamber is lowered, an automatic gas supply valve mechanism for usually closing the gas supply port, an automatic gas exhaust valve mechanism for usually closing the gas exhaust port, a valve press rod disposed between the automatic gas supply valve mechanism and the pulsation suppression diaphragm, which is actuated so as to open usually the gas supply port when the pulsation suppression diaphragm is moved beyond a predetermined stroke in the direction of expanding the liquid chamber, and a slider disposed between the automatic gas exhaust valve mechanism and the pulsation suppression diaphragm, which is actuated so as to open usually the gas exhaust port when the pulsation suppression diaphragm is moved beyond a predetermined stroke in the direction of reducing the liquid chamber, wherein the automatic gas exhaust valve mechanism includes:

a gas exhaust valve rod loosely inserted in a through hole of a spring receiving member fixed in the device body casing, so as to form a space, a gas exhaust valve element disposed on a tip of the gas exhaust valve rod, which can freely touch or separate from a valve seat of the gas exhaust port, and the slider arranged at a rear end of the gas exhaust valve rod so as to be slidable in an axial direction of the valve, a spring for a closing state is disposed between the gas exhaust valve element and the spring receiving member, and a spring for an opening state is disposed between the gas exhaust valve element and the slider.

2. A pulsation damping device for a pump, according to claim 1, wherein the device body casing is provided with an aperture for communicating with the gas chamber, and a valve case is detachably engaged with an inside of the aperture, the valve case is provided with the gas supply port, the gas exhaust port, the automatic gas supply valve mechanism, the valve press rod, the slider, the gas exhaust valve element of the automatic gas exhaust valve mechanism, the exhaust valve rod, the spring receiving member, the spring for a closing state, and the spring for an opening state.

3. A pulsation damping device for a pump, according to claim 1, wherein the device body casing is integrally provided with an air-driving type reciprocal pump, the air-driving type reciprocal pump includes a diaphragm for a pump, which is extendably and contractibly deformed in an extending and contracting direction of the pulsation suppression diaphragm, an air cylinder portion for driving the diaphragm for a pump so as to be extendably and contractibly deformed, and a pump working chamber disposed inside the diaphragm for a pump, the pump working chamber having suction and discharge check valves for sucking and discharging the transported liquid, the check valves being alternately opened and closed in accordance with extendable and contractible deformation of the diaphragm for a pump, and the transported liquid discharged from the pump working chamber via a discharge check valve is f edto the liquid chamber.

4. A pulsation damping device for a pump, according to claim 2, wherein a stopper is disposed on an end on a side of the gas chamber in the valve case, and the stopper restricts further movement of the pulsation suppression diaphragm when the pulsation suppression diaphragm moves in the direction of expanding the liquid chamber so as to be beyond a predetermined stroke and the valve press rod is actuated.

* * * * *